United States Patent [19]

Reynolds

[11] 4,444,175

[45] Apr. 24, 1984

[54] CONVECTION HEATED SECONDARY OVEN

[76] Inventor: Howard S. Reynolds, 1085 San Juan, Tustin, Calif. 92680

[21] Appl. No.: 437,143

[22] Filed: Dec. 29, 1982

[51] Int. Cl.[3] ..... A21B 1/00

[52] U.S. Cl. ..... 126/21 R; 126/273 R

[58] Field of Search ..... 126/19 R, 19.5, 20.1, 126/20.2, 21 R, 21 A, 198, 273 R, 273 A, 275 R

[56] References Cited

U.S. PATENT DOCUMENTS

| | | | |
|---|---|---|---|
| 247,908 | 10/1881 | Hawley | 126/273 R |
| 485,852 | 11/1892 | Warren | 126/21 R |
| 495,027 | 4/1893 | Dengel | 126/21 R |
| 744,945 | 11/1903 | Tucker | 126/273 R |
| 977,408 | 11/1910 | Kingsland | 126/273 R |
| 1,964,372 | 6/1934 | Tygart | 126/273 R |
| 3,167,065 | 1/1965 | Delfrancia | 126/273 R |
| 3,205,884 | 9/1965 | Locher | 126/273 A |
| 3,818,171 | 6/1974 | Miller | 126/21 A |
| 4,123,643 | 10/1978 | Burke | 126/273 R |
| 4,180,049 | 12/1979 | Carr | 126/21 A |

*Primary Examiner*—Daniel J. O'Connor
*Attorney, Agent, or Firm*—William H. Maxwell

[57] ABSTRACT

A secondary oven heated by restricted heat transfer from a primary oven through a common pan-roof tempered by convention flow of ambient outside air adjustably mixed with primary oven vent air controlled by a damper diverting a portion of primary oven vent air through the secondary oven with the balance thereof discharged externally.

20 Claims, 6 Drawing Figures

CONVECTION HEATED SECONDARY OVEN

BACKGROUND

This invention relates in particular to commercial kitchens, where holding ovens are used as distinguished from baking ovens. In order to hold foods in a warm condition, it is necessary to have control over the oven temperature, a normal holding temperature being 160° to 200° F. In practice, baking ovens operate up to and above 550° F. with vents that continuously discharge burnt gas with a large proportion of heated air. The oven vent discharge is usually within a range of 500° to 600° F. during normal kitchen operations and is a source of heat greater than that required to maintain a holding oven temperature. Conventionally, this vent heat is simply waste heat. Therefore, it is a primary object of this invention to advantageously utilize the vent discharge heat source of a baking oven for convection heating the interior of a separate holding oven without resort to any other heat source, thereby usefully conserving heat.

Heretofore, baking and holding ovens of the type under consideration have been heated by conduction and by individual heat sources, electrical or gas; it being gas stoves and ovens with which this invention is particularly concerned. Gas stoves and ovens are temperature controlled by means of thermostats, a gas heated baking oven having gas burners for maintaining a temperature of for example 550° F., and a gas heated holding oven having gas burners for maintaining a moderate temperature of approximately 200° F. Heretofore, baking and holding ovens have been essentially the same in construction, and the latter being essentially the same and as costly as the former. Therefore, it is an object of this invention to reduce the cost of holding ovens by providing heat transfer by convection from a primary baking oven into a secondary holding oven. It is also an object of this invention to provide heat control whereby the holding oven temperature can be regulated as circumstances required. In practice, damper controls are provided.

Heretofore, secondary ovens have been subjected to flue heat of primary ovens so that flue heat is conducted through the secondary oven walls to heat the secondary oven chamber. However, such an arrangement is not altogether satisfactory, as a thermostat controlled oven turns the fire on and off with commensurate fluctuations in flue heat. Accordingly, it is an object of this invention to moderate any fluctuations in flue heat by providing a heat transfer wall between the primary and secondary ovens which limits a substantially constant heat transfer by conduction therebetween. In practice, the primary oven temperature remains substantially constant while the flue heat thereof will fluctuate. In carrying out this invention, the pan of the secondary oven is common to the roof of the primary oven, for limited heat transfer by conduction therethrough whereby the secondary oven temperature is held to a substantially constant reduced level. For example, the baking range of a typical primary oven is 250° to 600° F., in which case the limited heat transfer through the common pan-roof is 150° to 200° F. In accordance with this invention, the pan-roof heats ambient inlet air to said 150° to 200° F. range, to be supplemented by the forceful hot vent air from the primary oven, as circumstances require to adjust to the desired holding temperature.

The normal vent discharge temperature of a baking oven is in the range of 500° to 550° F., while the normal ambient air temperature in a kitchen is 75° to 80° F. It is to be understood that these temperature ranges vary from one kitchen to another. Accordingly, it is an object of this invention to temper ambient inlet air by conduction of primary oven heat through the aforesaid pan-roof for convection flow within the secondary oven chamber, and by proportionally commingling hot air therewith, namely with the primary oven vent air. In practice therefore, the primary baking oven vent is controlled by a damper that discharges into the secondary holding oven, there being an ambient air inlet into the holding oven tempered by the pan-roof and by the primary vent air. The upward flow of heated air is by means of convection in both instances, and in accordance with this invention it is an object to vent the secondary holding oven in such a way that the commingling of prinary oven vent air with secondary oven ambient inlet air is automatic. To this end, the secondary vent opening of the secondary holding oven is equal to or greater in area than the primary holding oven vent. And in order to reduce temperature to a holding range, the ambient inlet openings of fixed area are provided. In practice, with the oven doors closed, the discharge at the secondary holding oven vent cannot exceed, by convection, the inlet from either or both the primary oven vent and/or the ambient inlet. In this manner, complete control is achieved through the single primary oven vent damper, the excess primary vent air being discharged in a conventional manner at the rear of the primary baking oven.

A feature of this invention is that the constructions of the primary baking oven and the secondary holding oven can be conventional in most every respect, except as herinafter described. The requesites are, that the primary baking oven must provide an exhaust vent of hot air at or above the holding oven temperature desired, and that the secondary holding oven be placed above and preferably over the primary baking oven. In carrying out this invention, the primary baking oven is vented partially or completely through the secondary holding oven as circumstances required. By operating the primary oven at sufficiently high heat, the secondary oven can also be used for baking.

SUMMARY OF INVENTION

This invention relates to baking and holding ovens, and particularly to gas fired ovens, but not to exclude any vented oven. The primary purpose of this invention is to associate a secondary holding oven with a primary baking oven, whereby the temperature is held constant. Accordingly, the secondary holding oven of the present invention is combined with and/or dependent upon the hot air discharge of the primary baking oven. Novelty resides in the vent relationship of the primary and secondary ovens, and in the ambient air inlet into the secondary oven. Holding oven temperature is acurately determined with a single vent damper disposed between the two ovens, diverting excess primary oven heat as may be required to determine the desired secondary holding oven temperature.

The foregoing and various other objects and features of this invention will be apparent and fully understood from the following detailed description of the typical preferred forms and applications thereof, throughout which description reference is made to the accompanying drawings.

PREFERRED EMBODIMENT

Figure 1:
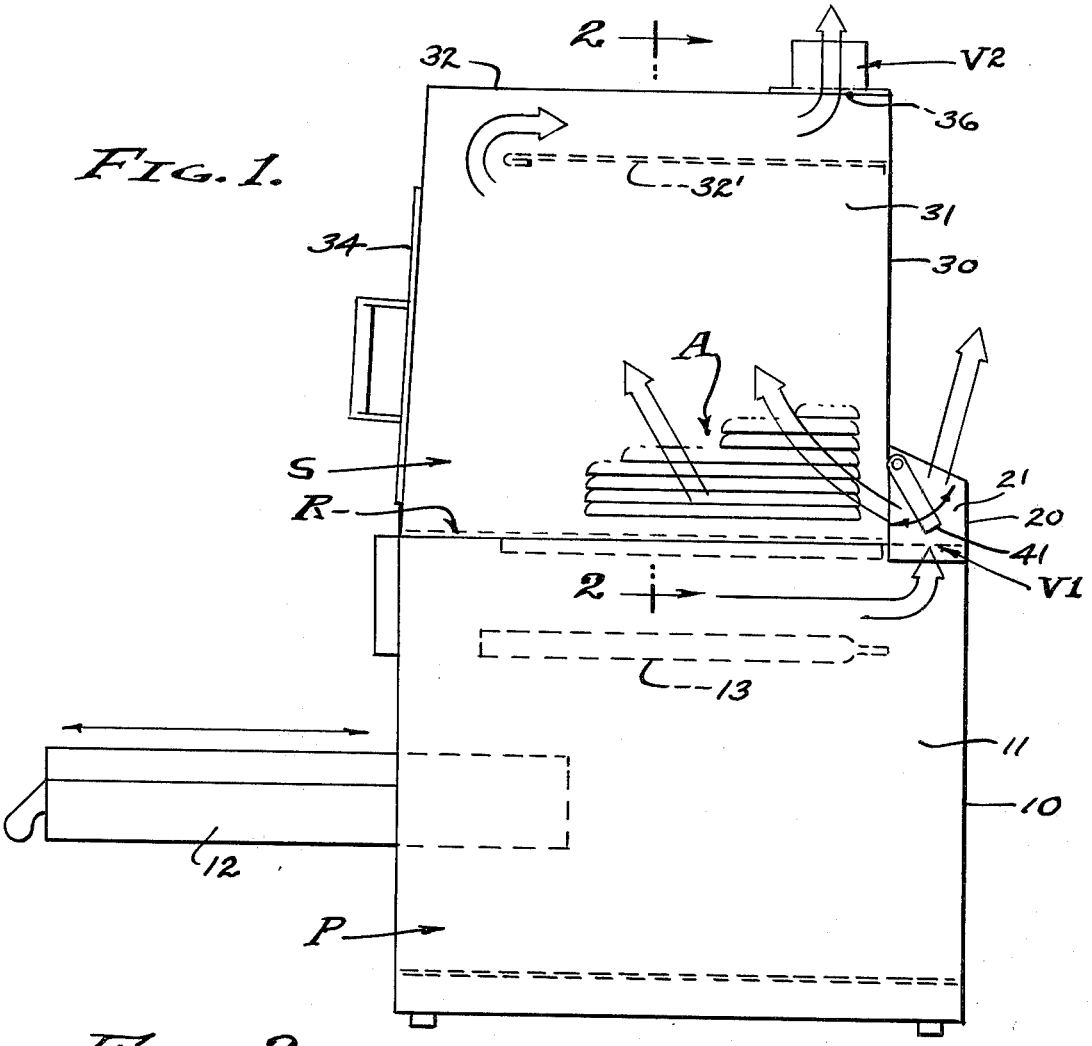
FIG. 1 is a side elevation of the convection heated secondary oven of the present invention shown installed on a primary oven.
Figure 2:
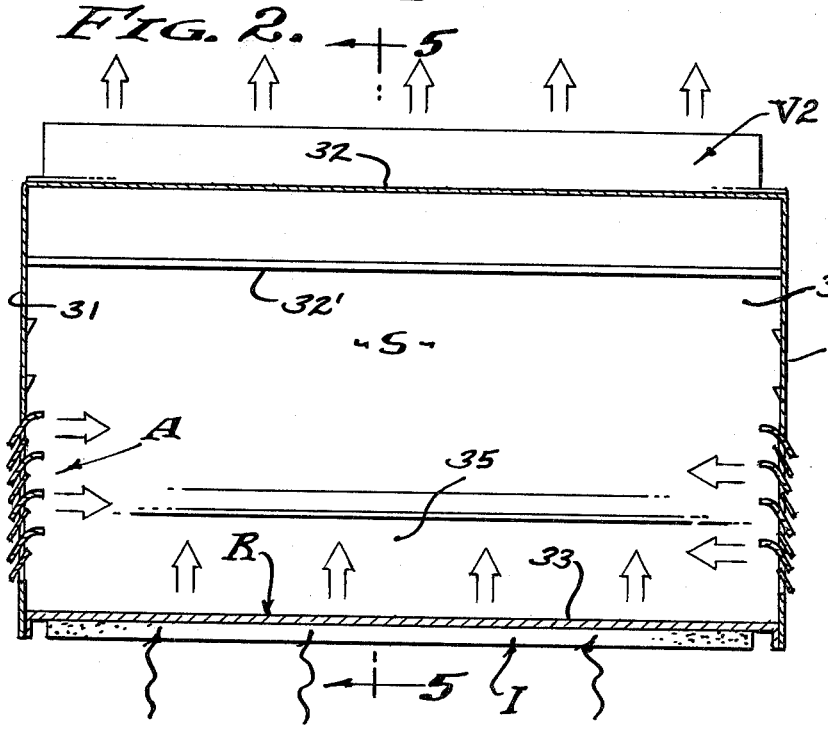
FIG. 2 is a transverse cross section through the secondary oven taken as indicated by line 2—2 of FIG. 1.
Figure 3:
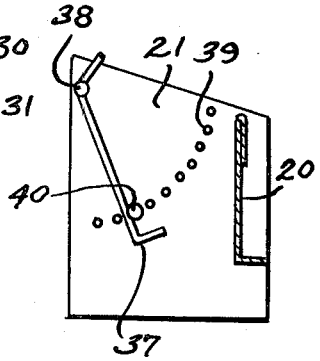
FIG. 3 is an enlarged detailed view of the damper control. And, FIGS. 4, 5 and 6 are enlarged sectional views taken as indicated by line 5—5 on FIG. 2, FIG. 4 showing the damper closed to the secondary oven, FIG. 5 showing the damper dividing the primary oven vent air to flow into the secondary oven and to the exterior, and FIG. 6 showing the damper open fully to the secondary oven and closed to the exterior.
Figure 4:
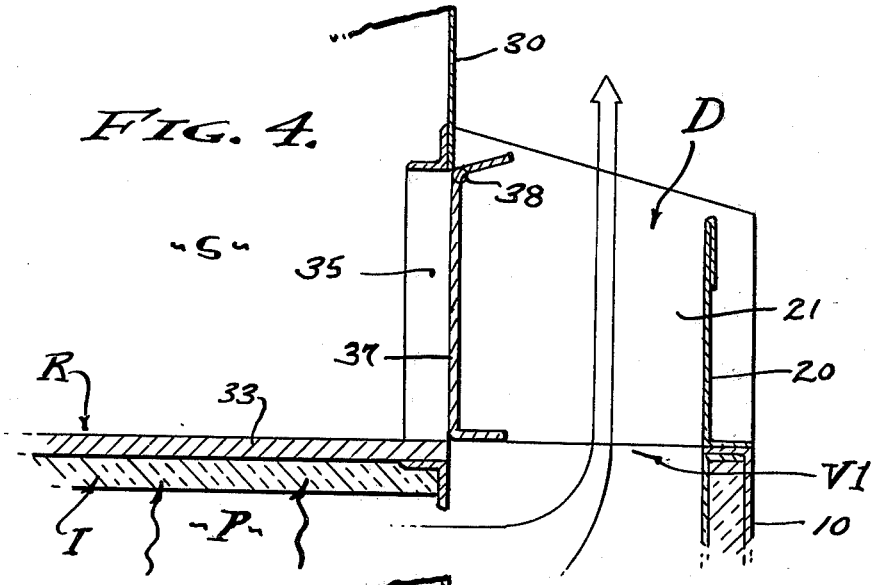
Figure 5:
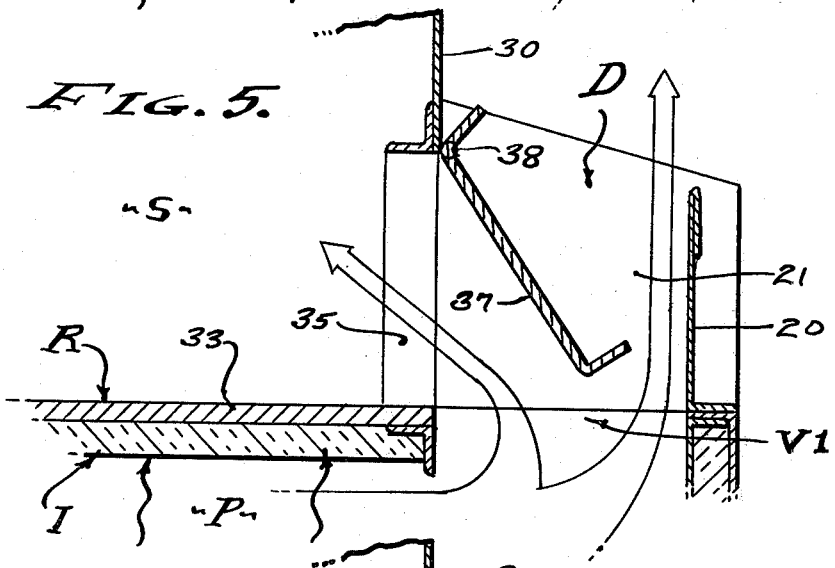
Figure 6:
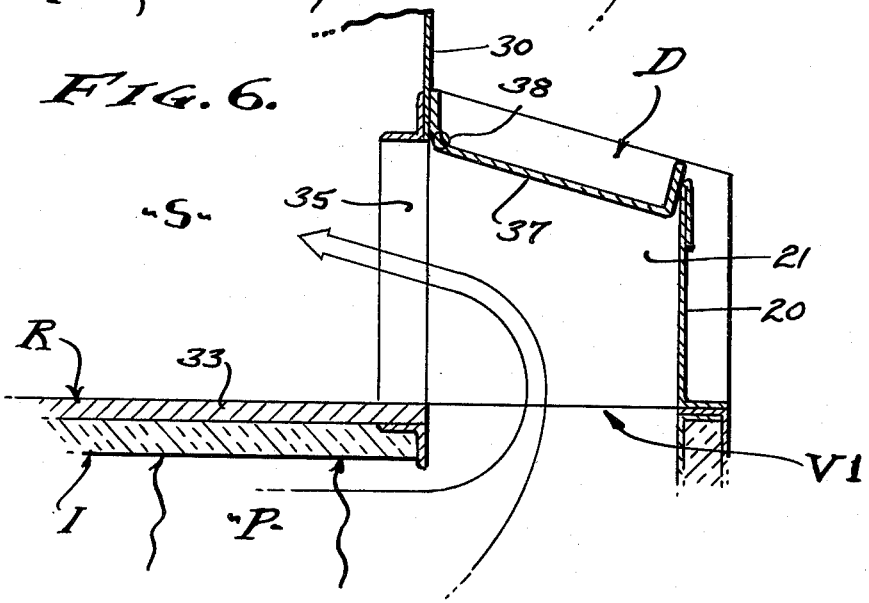

Referring now to the drawings, there is a primary oven P and a secondary oven S. In accordance with this invention, it is most practical to superimpose the secondary oven over the primary oven as shown, there being a damper means D disposed therebetween. Each of said ovens is vented as will be described, and a feature is the ambient air inlet A into the secondary holding oven, whereby temperature control is automatic dependent upon a controlled temperature from the primary oven. Although reference is specifically made to primary baking ovens P, it is to be understood that any such oven as for example the so called "Cheese Melter" illustrated herein is to be included in that category, as it complies with the requirement of providing an exhaust vent of heated air in excess of the temperature desired within the secondary holding oven S.

The primary oven P is a front opening cabinet comprised of a back side panel 10 and side panels 11 provided with a front and rear leveling means such as floor engaging screw pads. The panels 10 and 11 are double walled sheet metal constructions with insulation as required therebetween, and having coplanar top edges, and closed at the bottom by a pan. The top of the primary oven P is preferably open, to be closed by a common pan-roof R which is built into the secondary oven S as an integral part thereof. An elevator-drawer 12 functions to be loaded with food and to be positioned with respect to top heat radiant burners 13. The elevator-drawer 12 is moveable with respect to the burners 13 operated at a constant heat that is preferably manually but can be thermostatically controlled. As shown, the primary oven P exhausts at the top rear, there being a vent V1 in the form of a transverse slot defined by the pan-roof R and back panel 10 and coextensive between the side panels 11. Most of the hot air discharged from the primary oven P is exhausted through the vent V1 and is conventionally drawn away through a kitchen flue, a hook or the like, located above the stove installation. A normal oven discharge of heat fron vent V1 is 500° to 550° F.

A conventional primary oven vent is essentially a full chimney having four walls. However, the vent V1 of the present invention is modified to have a back wall 20 and side walls 21 only, the front as well as the top thereof being open for the discharge of hot air. In practice, such vents are of a restricted height; example two or three inches. As hereinafter described, the damper D is cooperatively related to the modified vent V1 of the primary oven P; or alternatively the vent V1 can be separate or built integrally into the secondary holding oven S.

The secondary holding oven S is a front closing cabinet comprised of a back side panel 30, side panels 31, a top panel 32, and the common pan-roof R or bottom panel 33. Closing doors 34 form the front of the oven S, the closing doors 34 being double walled sheet metal constructions with insulation as required therebetween. As shown, the side panels 31 of the holding oven S continue upward from the side panels 11 of primary oven P, as do the doors 34 from the front opening of oven P, while the back panel 30 is offset forward or back panel 10 a distance to be in the vertical plane of the forward opening of vent V1. In practice, the side walls 21 of vent V1 continue into the side walls 31 of the secondary holding oven S. In accordance with this invention, there is an opening 35 in the back panel 30, complementary to the front opening of the vent V1. The common pan-roof R is a substantially heavy plate that comprises the bottom panel 33 to form the pan of the secondary oven S and the roof of the primary oven P. The greater area of the panel 33 is covered by an underlying heat insulating shield I. It will be apparent how the ovens P and S are fitted one to the other with the top opening of vent V1 open to atmosphere, with the front opening thereof open into the secondary holding oven S at the bottom rear thereof, and with the heat transfer capability of the common pan-roof R limited by the insulation shield I.

In accordance with this invention, there is of louvered ambient air inlet A through each side panel 31 and above the bottom panel 33. The louvers of inlet A are turned horizontally as they enter the secondary oven chamber, so that ambient inlet air is directed horizontally as shown. In carrying out this invention the air inlet or inlets open immediately above the heat transfer plate or panel 33 for conduction (radiant) heating of ambient air entering therein for upward convection flow. Accordingly, the ambient air inlet or inlets A will provide a cooling air flow into the secondary holding oven S.

In accordance with this invention, the secondary holding oven S exhausts at the top rear, there being a vent V2 in the form of a transverse slot 36 through the top panel 32 and coextensive between the side panels 31. The vent V2 draws convection air from a slot at the front top of the oven chamber and through a tunnel formed by a false top panel 32', thereby establishing cross flow. In carrying out this invention the area of the slot 36 is greater than the area of the aforesaid opening 35, and likewise is greater than the area of the ambient air inlet A. Accordingly, the vent V2 will provide an air flow equal to or greater than the airflow capacity of the ambient air inlet or inlets A and will provide an airflow equal to or greater than the airflow capacity of vent V1 and opening 35. An unobvious feature is that the dynamic convection flow capacity of hot air from the vent V2 exceeds the dynamic convection flow capacity of colder ambient air through the inlet or inlets A. Consequently, the hot primary oven P exhaust through vent V1 as it is controlled by the damper means D forcefully enters and flows through the secondary oven S and from its vent V2, and supplements the colder ambient air with hoter primary oven vent air. The ambient air inlets A then automatically supply the amount of air required to satisfy the discharge through vent V2, as determined by controlled restriction of air flow through opening 35 by the damper means D. Accordingly, there is a balance of hot primary oven vent air proportioned to the inlet of colder ambient air.

The damper means D is a flow divider unit that separates the hot air exhaust from the primary oven P so it flows proportionately from the top opening and forward opening of vent V1. As shown, the damper means D comprises a flap member 37 that swings about a pivot 38 to fully occupy either the top opening or forward opening of vent V1, the pivot 38 being located at the edges of the said openings which are common, and namely at the top edge of the opening 35. In practice, the flap member 37 has a dividing edge that swings between the lower edge of opening 35 and the back wall 20 of vent V1, and thereby proportionately divides the upward convection flow of hot air between the top opening and forward opening of said vent. Detent means 40 comprised of a series of arcuately spaced recesses 39 receiving a spring biased bolt maintains a selected positioning of the flap member 37. The flap member 37 of the damper means D is manually positioned as by a lever 41, so the proportioning of hot and cold air will maintain the holding oven temperature desired.

From the foregoing it will be seen that the secondary oven S operates by convection in its placement above the primary oven P. The vented exhaust air from the primary oven P is diverted as required into the secondary oven S where it commingles with radiantly heated ambient inlet air. Normal operation of the primary oven P provides hot exhaust air in the range of 325° to 600° F., which is adequate to maintain a secondary holding oven S temperature in the range of 150° to 200° F. Therefore, the damper means D is adjusted accordingly to by-pass a proportionate flow of hot air from vent V1 and into the secondary holding oven S to supplement the conduction heated ambient air. Thus, the controlled flow of hot primary oven air is proportionately mixed with colder ambient inlet air in the secondary oven to control the temperature therein.

Having described only the typical preferred form and application of my invention, I do not wish to be limited or restricted to the specific details herein set forth, but wish to reverse to myself any modifications or variations that may appear to those skilled in the art as set forth within the limits of the following claims.

I claim:

1. A secondary convection oven above a primary oven and heated thereby, said including in combination;

a common pan-roof separating the two ovens, burner means in the primary oven and a first hot air exhaust vent discharge therefor, an ambient air inlet through a side of the secondary oven for convection flow of outside air into said oven, adjustable damper means at the first hot air exhaust vent of the primary oven dividing the said hot air exhaust from the burner means for convection flow proportionately into the secondary oven and externally of said two ovens, and a second hot air exhaust vent from the secondary oven, selective adjustment of said adjustable damper means increasing and decreasing secondary oven temperature.

2. The secondary and primary oven combination as set forth in claim 1, wherein the common pan-roof is a heat conductor of primary oven heat into the secondary oven for heating of the ambient inlet air.

3. The secondary and primary oven combination as set forth in claim 1, wherein the common pan-roof is a heat conductor of primary oven heat with insulation restricting the transfer of primary oven heat into the secondary oven for limited heating of the ambient inlet air.

4. The secondary and primary oven combination as set forth in claim 1, wherein the burner means is a top burner means that includes radiants, and wherein the common pan-roof is a heat conductor of radiant heat into the secondary oven for heating of the ambient inlet air.

5. The secondary and primary oven combination as set forth in claim 1, wherein the burner means is a top burner means that includes radiants, and wherein the common pan-roof is a heat conductor of radiant heat with insulation restricting the transfer of primary oven heat into the secondary oven for limited heating of the ambient inlet air.

6. The secondary and primary oven combination as set forth in claim 1, wherein the ambient air inlet is above the common pan-roof and into the secondary oven.

7. The secondary and primary oven combination as set forth in claim 1, wherein the ambient air inlet is at the opposite sides of and extending forwardly from the back of the secondary oven and above the common pan-roof and into the secondary oven.

8. The secondary and primary oven combination as set forth in claim 1, wherein the ambient air inlet is comprised of louvers turned horizontally into the secondary oven above the common pan-roof and into the secondary oven.

9. The secondary and primary oven combination as set forth in claim 1, wherein the ambient air inlet is at the opposite sides of and extending forwardly from the back of the secondary oven and above the common pan-roof and into the secondary oven, and wherein the ambient air inlet is comprised of louvers turned horizontally into the secondary oven immediately above the common pan-roof and into the secondary oven.

10. The secondary and primary oven combination as set forth in claim 1, wherein the adjustable damper means overlies the first hot air exhaust vent of the primary oven and comprises a flop member moveable alternately between a top opening to the exterior of said two ovens and a forward opening into the secondary oven.

11. The secondary and primary oven combination as set forth in claim 1, wherein the adjustable damper means overlies the first hot air exhaust vent of the primary oven and comprises a moveable flap member with a lever operated detent means and positionable alternately between a top opening to the exterior of said two ovens and a forward openinginto the secondary oven.

12. The secondary and primary oven combination as set forth in claim 1, wherein the secondary and primary ovens and separable units and the adjustable damper means is a separate unit disposed therebetween and overlies the first hot air exhaust vent of the primary oven and comprises a flap member moveable alternately between a top opening to the exterior of said two ovens and a forward opening into the secondary oven.

13. The secondary and primary oven combination as set forth in claim 1, wherein the secondary and primary ovens are separable units and the adjustable damper means is a separate unit disposed therebetween and overlies the first hot air exhaust vent of the primary oven and comprises a moveable flap member with a lever operated detent means and positionable alternately between a top opening to the exterior of said two ovens and a forward opening into the secondary oven.

14. The secondary and primary oven combination as set forth in claim 1, wherein the primary oven heat range is 250° to 600° F., and wherein the common pan-roof is a heat conductor of primary oven heat with insulation restricting the secondary oven heat range to 150° to 200° F. for limited heating of the ambient inlet air.

15. The secondary and primary oven combination as set forth in claim 1, wherein the area of the second hot air exhaust vent from the secondary oven is greater than the area of the damper means opening into the secondary oven.

16. The secondary and primary oven combination as set forth in claim 1, wherein the area of the second hot air exhaust vent from the secondary oven is greater than the area of the ambient air inlet opening into the secondary oven.

17. The secondary and primary oven combination as set forth in claim 1, wherein the area of the second hot air exhaust vent from the secondary oven and the area of the damper means opening into the secondary oven and are greater than the area of the ambient air inlet opening into the secondary oven.

18. The secondary and primary oven combination as set forth in claim 1, wherein the primary oven heat range is 250° to 600° F., wherein the common pan-roof is a heat conductor of primary oven heat with insulation restricting the secondary oven heat range to 150° to 200° F. for limited heating of the ambient inlet air, and wherein the area of the second hot air exhaust vent from the secondary oven and the area of the damper means opening into the secondary oven are greater than the area of the ambient air inlet opening into the secondary oven.

19. The secondary and primary oven combination as set forth in claim 1, wherein the area of the second hot air exhaust vent from the secondary oven is at least as great as the area of either the first hot air exhaust vent of the primary oven and of the ambient air inlet opening into the secondary oven.

20. The secondary and primary oven combination as set forth in claim 1, wherein the burner means is a top burner means that includes radiants and the common pan-roof is a heat conductor of radiant heat with insulation restricting the transfer of primary oven heat into the secondary oven for limited heating of the ambient air, wherein the ambient air inlet is comprised of louvers turned horizontally into the secondary oven above the common pan-roof and into the secondary oven, wherein the adjustable damper means overlies the first hot air exhaust vent of the primary oven and comprises a moveable flap member with a lever operated detent means and positionable alternately between a top opening to the exterior of said two ovens and a forward opening into the secondary oven, and wherein the area of the second hot air exhaust vent from the secondary oven and the area of the damper means opening into the secondary oven are greater than the area of the ambient air inlet opening into the secondary oven.

* * * * *